US006481666B2

(12) United States Patent
Frucht

(10) Patent No.: US 6,481,666 B2
(45) Date of Patent: Nov. 19, 2002

(54) METHOD AND SYSTEM FOR GUIDING SUBMUNITIONS

(76) Inventor: Yaacov Frucht, 2/34 Hageula Street, Neve Alon, Akko (IL), 24615

( * ) Notice: Subject to any disclaimer, the term of this patent is extended or adjusted under 35 U.S.C. 154(b) by 0 days.

(21) Appl. No.: 09/821,909

(22) Filed: Mar. 30, 2001

(65) Prior Publication Data

US 2001/0025901 A1 Oct. 4, 2001

(30) Foreign Application Priority Data

Apr. 4, 2000 (IL) ..... 135449

(51) Int. Cl.[7] ..... F41G 7/00; F42B 10/62; F42B 15/01

(52) U.S. Cl. ..... 244/3.15; 244/3.1; 244/3.19; 244/3.21; 342/357.01; 342/357.06

(58) Field of Search ..... 244/3.1, 3.15, 244/3.16–3.3; 701/200, 207, 213–226; 342/357.01–357.17

(56) References Cited

U.S. PATENT DOCUMENTS

| | | | | |
|---|---|---|---|---|
| 4,492,166 A | | 1/1985 | Purcell | |
| 4,554,871 A | | 11/1985 | Nixon | |
| 4,635,553 A | | 1/1987 | Kane | |
| 4,848,235 A | | 7/1989 | Postler et al. | |
| 4,949,089 A | | 8/1990 | Ruszkowski, Jr. | |
| 5,131,602 A | | 7/1992 | Linick | |
| 5,155,294 A | | 10/1992 | Vesa | |
| 5,260,709 A | | 11/1993 | Nowakowski | |
| 5,344,105 A | | 9/1994 | Youhanaie | |
| 5,507,452 A | | 4/1996 | Mayersak | |
| 5,786,790 A | | 7/1998 | Abbott | |
| 5,943,009 A | | 8/1999 | Abbott | |
| 6,037,899 A | * | 3/2000 | Weber | 342/357.06 |

FOREIGN PATENT DOCUMENTS

| | | |
|---|---|---|
| WO | WO99/02936 A3 | 1/1999 |
| WO | WO99/02936 A2 | 1/1999 |

OTHER PUBLICATIONS

Armada International paper 3/98–001d posted on the Internet at www.armada.ch; no author listed; no date given.*

Craig Covault, "Locass Attack System Development Advances"; "Aviation Week and Space Technology," vol. 149, issue 17, p. 52; Oct. 26, 1998.*

Article entitled, "Aerodynamic Decelerators, The Year in Review," by Donald Waye in Aerospace America, p. 9, Dec. 1995.

* cited by examiner

*Primary Examiner*—Bernarr E. Gregory
(74) *Attorney, Agent, or Firm*—Cook, Alex, McFarron, Manzo, Cummings & Mehler, Ltd.

(57) ABSTRACT

A submunition for delivery in a carrier, the submunition including a satellite aided global location system guidance system mounted on the submunition for guiding the submunition towards a pre-selected target after delivery to a target area by the carrier, and a method for guiding a submunition after delivery from a carrier, the method including mounting a satellite aided global location system guidance system on the submunition and utilizing the satellite aided global location guidance system to guide the submunition towards a pre-selected target.

9 Claims, 2 Drawing Sheets

METHOD AND SYSTEM FOR GUIDING SUBMUNITIONS

FIELD OF THE INVENTION

The present invention relates to submunitions in general and, in particular, to a method and system for guiding submunitions.

BACKGROUND OF THE INVENTION

Submunitions of various kinds, which are ejected or dispersed from a carrier, such as a missile, mortar or rocket, have long been known in the art. Generally, the carrier brings the submunitions to a location close to the target, and the submunitions are ejected or dispersed near the target. The submunitions either free fall from the ejection location relying on statistical distribution to hit the target, or include a guidance system to move them closer to the target. A number of methods are known for guiding the submunitions to the final target. One method employs terminal guidance systems, such as infrared seekers and other IR detection and guidance systems, as shown, for example, in U.S. Pat. No. 4,492,166.

Another method includes providing a mechanical control system, such as aerofoils or special wings with a target detector, such as those shown in U.S. Pat. No. 5,155,294 and U.S. Pat. No. 4,635,553.

There is shown in U.S. Pat. No. 4,554,871 to Allied Corporation a missile carrying at least two asymmetric submunitions. The guidance system on each submunition causes the submunition to precess about its center axis, thus creating an appropriate search pattern, or controlling the flight path of the submunition after a suitable target has been acquired by the submunition's guidance system.

Satellite aided global location systems, such as the Global Positioning System (GPS) and Glonas, are also well known in the art. These utilize several satellites to permit a body on the earth to calculate, such as by triangulation, its precise location on the globe. Global location systems today are used in guidance systems for a wide variety of objects. These include munitions, such as bombs and missiles.

There is shown, for instance, in U.S. Pat. No. 5,943,009 to Northrop Grumman Corporation, a tail fin assembly for a munition having a housing configured for attachment to the munition, at least one flight control surface having an actuator, and a guidance system having a GPS receiver for effecting control of the actuator mechanism, so as to facilitate guiding of the munition.

U.S. Pat. No. 5,260,709 describes a system and method that uses differential computation of position relative to a GPS coordinate system and the computation of an optimum weapon flight path to guide a weapon to a non-moving fixed or relocatable target. The system comprises an airborne platform that uses a navigation subsystem that utilizes the GPS satellite system to provide the coordinate system and a synthetic array radar (SAR) to locate desirable targets. Targeting is done prior to weapon launch, the weapon therefore requires only a navigation subsystem that also utilizes the GPS satellite system to provide the same coordinate system that the platform used.

There is shown in U.S. Pat. No. 5,507,452 a precision guided system suitable for use in conventional aircraft launched bombs. The system includes a kit mounted upon the nose of the conventional bomb which replaces the conventional fuse disposed in a fuse well, the kit including guidance electronics controlling a self-contained jet reaction device and GPS P-code receiver electronics. The bombs are readied for discharge by signals broadcast from the aircraft into the bomb bay which transfer initial GPS data and commence operation of a gas generator which powers the jet reaction device.

All these systems include use of satellite aided global location systems to guide a relatively large, heavy munition, for example, a typical artillery shell which weighs about 50 kilos, flying at a speed of 400–500 meters/second, generally over a relatively long distance. Thus, the electronics and control system required to guide the munition are complex and expensive to manufacture and maintain.

SUMMARY OF THE INVENTION

It is an object of the present invention to provide a relatively simple and inexpensive method of guiding a submunition to its target after ejection from its carrier. This is accomplished by utilizing a satellite aided global location system (i.e., GPS or Glonas) guidance system for each submunition itself, rather than for the carrier munition.

There is provided according to the present invention a submunition for delivery in a carrier, the submunition including a satellite aided global location system guidance system mounted on the submunition for guiding the submunition towards a pre-selected target after delivery to a target area by the carrier.

According to a preferred embodiment, the satellite aided global location system guidance system includes a servo system, a global location system receiver, and a processor coupled to the servo system and to the global location system receiver.

According to a preferred embodiment of the invention, the submunition further includes inertial sensors.

There is also provided a method for guiding a submunition after delivery from a carrier, the method including mounting a satellite aided global location system guidance system on the submunition and utilizing the satellite aided global location guidance system to guide the submunition towards a pre-selected target.

According to one embodiment of the invention, the satellite aided global location system guidance system includes a servo system; a global location system receiver; and a processor coupled to the servo system and to the global location system receiver; and the step of utilizing the satellite aided global location system guidance system includes programming a pre-selected target point and flight path to the target point into the processor of each submunition; after the submunition is released, receiving signals from satellite aided global location system satellites in the global location system receiver; calculating the actual location of the submunition from the received signals; comparing the actual location with the desired location on the programmed flight path; and, if the actual location differs from the desired location, altering the actual flight path so as to guide the submunition to the pre-selected target point.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a method for guiding a submunition to a pre-selected target, and to a submunition utilizing the method. The invention utilizes a satellite aided global location system guidance system coupled to each submunition to guide that submunition to its own pre-selected target, which can be the same or different from each of the other submunitions in a single carrier. For purposes of the present specification, the term satellite aided global location system will be used to include GPS, GLONAS, and any other global location system.

It is a particular feature of the invention that, due to the relatively light weight of the submunition, i.e., on the order of 10–15 kilos, the relatively low speed, generally about 20–30 m/sec for a gliding parachute guided submunition, and the relatively short distance over which guidance is required, a relatively simple and inexpensive guidance system can be utilized. This is because the aerodynamic load changes as the square of the speed. Thus, if the speed of the submunition is, for example, 20 m/sec, while that of a munition is 400 m/sec, the aerodymanic load is reduced by a factor of $20^2$ or some 400 times. In addition, the inertial moment is reduced to one fifth. This means that a large, fast munition has 2000 times the requirements from the control system as a small, slow submunition.

Furthermore, to control a parachute or winglets on a submunition, only a very simple servo system is required, for example, a rotational motor pulling the strings of the parachute, as opposed to the complex servo systems required for rockets and other munitions, due to their aerodynamic load and high speed. Another advantage of the present invention, is that the time constant for a submunition suspended from a parachute is much lower than that of a munition, so there is much more time to alter or correct the flight path. This means that a submunition can utilize a control system (i.e., servo and electronics) which responds more slowly than that required for a munition, as well as simpler and less expensive inertial sensors. It will be appreciated that such a system provides precise guidance to a selected target at relatively low cost. This results in a very inexpensive weapon with a launch and leave (autonomous) capability.

Figure 1A:
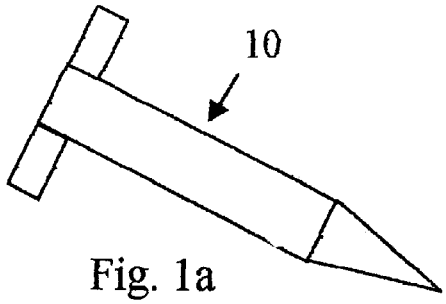
FIGS. 1*a*, 1*b* and 1*c* are schematic illustrations of a method incorporating one embodiment of the invention.
Figure 1B:
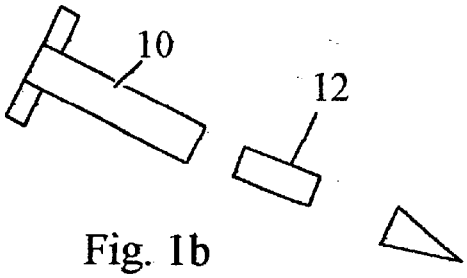
Figure 1C:
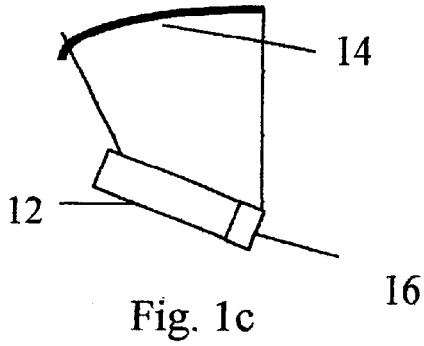

Referring now to FIGS. 1*a*, 1*b* and 1*c*, there is shown a schematic illustration of a method incorporating one embodiment of the invention. In this embodiment, a carrier 10, such as a rocket or other projectile, carries at least one submunition 12. Carrier 10 can be delivered to the target area using any kind of conventional guidance system. At the appropriate time, carrier 10 ejects submunitions 12, or the tail end (carrier) 10 separates from one or two submunitions 12, as shown in FIG. 1*b*. Each submunition 12, as shown in detail in FIG. 1*c*, includes a control surface 14 which controls flight direction and angular orientation, here illustrated as a gliding parachute, and a satellite aided global location system guidance system 16. Alternatively, any other control surface which can be controlled by the satellite aided global location system guidance system can be utilized, including but not limited to wings, tail fins, jet reaction devices, all as known.

Figure 2:
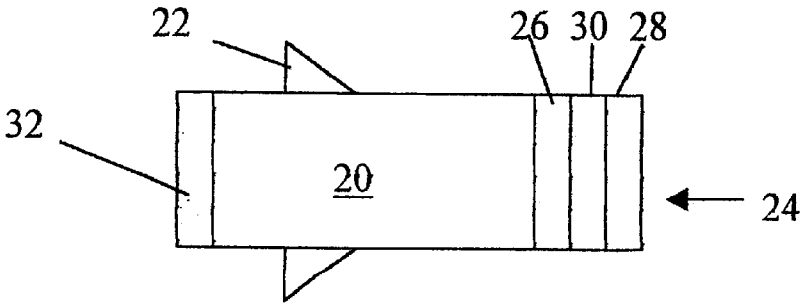
FIG. 2 is a schematic detail illustration of a submunition constructed and operative in accordance with one embodiment of the invention.

FIG. 2 is a schematic detail illustration of a submunition 20 constructed and operative in accordance with one embodiment of the invention. Submunition 20 includes a control surface 22, here illustrated as a pair of winglets, and a satellite aided global location system guidance system 24. Satellite aided global location system guidance system 24 includes a servo system 26, a global location system receiver 28, and a processor 30 coupled to the servo system 26 and to the global location system receiver 28. Processor 30 is arranged to receive location data from the global location system receiver 28 and provide commands to servo system 26 to activate the control surface 22 to alter the flight path. Servo system 26 can include any conventional servo system, including, for example, a device for pulling the strings of a parachute, a device for moving winglets or other direction control surface, an electric motor, thrusters, etc. Suitable servo systems include, but are not limited to, model airplane servos, such as those manufactured by Tonigawa, Japan.

According to one embodiment of the invention, where it is important to take into account the angular orientation of the submunition in calculating changes in flight path, the submunition further includes inertial sensors 32, also coupled to processor 30. Suitable inertial sensors include, but are not limited to, ADXL family of accelerometers, manufactured by Analog Devices, Inc, Norwood, Mass., USA, and low performance rate (solid state) gyroscopes, such as those manufactured by Murata, Japan.

It is a particular feature of the invention that the control surface, the servo system, and the satellite aided global location system guidance system of each submunition can be relatively simple and inexpensive. As stated above, this is due to the fact that a submunition is only a fraction of the weight of a conventional munition, and flies at a fraction of the speed. Since the carrier carries the submunition to the target area in free flight or utilizing conventional carrier guidance systems, the submunition's guidance system is required only to provide final guidance to the selected target from a relatively short range.

Figure 3A:
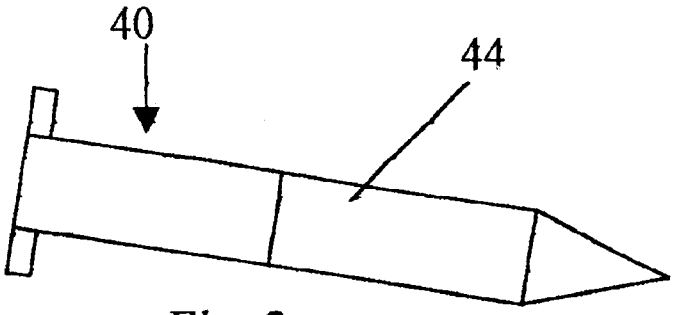
FIGS. 3*a*, 3*b* and 3*c* are schematic illustrations of a method incorporating an alternative embodiment of the invention.
Figure 3B:
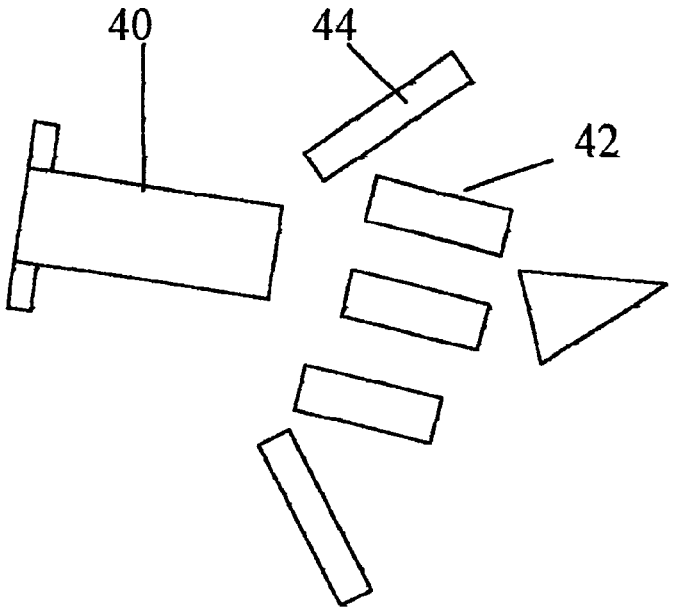
Figure 3C:
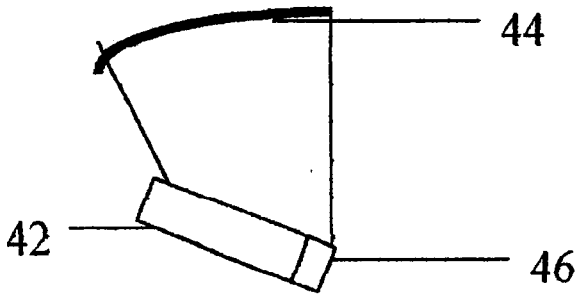

Referring now to FIGS. 3*a*, 3*b* and 3*c*, there are shown schematic illustrations of a method incorporating an alternative embodiment of the present invention. In this embodiment, the carrier 40 includes a two part rocket or similar two part projectile. At least one submunition 42, here illustrated as three submunitions, are carried in one part 44 of the carrier. Carrier 10 is delivered to the target area using any kind of conventional guidance system, as known. At the appropriate time, the part 44 separates from the rest of carrier 40 and, in turn, ejects or disperses submunitions 42. As known with conventional submunitions, a cluster can open and eject the submunitions, or the skin of the carrier can be cut and the submunitions dispersed, or the submunitions can be released in any other fashion. Each submunition 42, as seen in FIG. 3*c*, includes a control surface 44, here illustrated as a gliding parachute, and a satellite aided global location system guidance system 46, as described above.

It will be appreciated that the submunitions of the present invention are suitable for carrying a camera and video transmitter for providing video pictures of a target, in addition to, or instead of carrying explosives.

Operation of the submunition of the present invention is as follows. One or more submunitions are loaded into a carrier. The carrier flies to the target area and releases the submunitions. Each submunition has a pre-selected target point and flight path to the target point programmed into its processor. When as the submunition is released, the global location system receiver receives signals from the satellite aided global location system satellites. From these signals, the processor in the submunition calculates the actual location of the submunition and compares it with the desired location on the programmed flight path. If the actual location differs from the desired location, the processor sends commands to the servo system to activate the control surface to alter the actual flight path so as to guide the submunition to the pre-selected target point. In embodiments where the angular orientation of the submunition changes during flight, inertial sensors may be mounted on the submunition, to control the angular orientation of the body to permit steering. Alternatively, with a parachute or other control surface which holds the submunition at a fixed, known angle, inertial sensors are not necessary.

It will further be appreciated that the invention is not limited to what has been described hereinabove merely by way of example. Rather, the invention is limited solely by the claims which follow.

What is claimed is:

1. A submunition for delivery in a carrier, the submunition comprising:

a parachute control surface for controlling flight direction;

a satellite aided global location system guidance system mounted on the submunition and drivingly coupled to said control surface for guiding the submunition substantially to a pre-selected target after delivery to a target area by the carrier.

2. The submunition according to claim 1, wherein said satellite aided global location system guidance system includes:

a servo system;

a global location system receiver; and a processor coupled to the servo system and to the global location system receiver.

3. The submunition according to claim 2, wherein said processor includes a pre-determined flight path, and is arranged to receive location data from said global location system receiver and to send commands to said servo system to alter said predetermined flight path.

4. The submunition according to claim 1 comprising one or more explosives carried by said submunition.

5. A method for guiding a submunition after delivery from a carrier, the method comprising:

coupling a parachute control surface for controlling flight direction to the submunition;

mounting a satellite aided global location system guidance system on the submunition, drivingly coupled to said control surface; and utilizing said satellite aided global location system guidance system to drive said control surface to guide the submunition substantially to a pre-selected target.

6. The method according to claim 5 wherein said mounting step comprises:

mounting a satellite aided global location system guidance system including a servo system; a global location system receiver;

and a processor coupled to the servo system and to the global location system receiver; and the step of utilizing the satellite aided global location system guidance system includes:

programming a pre-selected target point and flight path to the target point into the processor of the submunition;

after the submunition is released, receiving, in said global location system receiver, signals from satellite aided global location system satellites;

calculating an actual location of the submunition from said received signals;

comparing said actual location with a desired location on said programmed flight path;

and, if said actual location differs from said desired location, altering the actual flight path so as to guide the submunition to the pre-selected target point.

7. The method according to claim 6, wherein said step of altering includes sending instructions to said servo system to alter the actual flight path of the submunition.

8. The method according to claim 6, further comprising the step of providing altitude attitude data to said processor; and using said altitude attitude data in generating said commands to said servo system.

9. The method according to claim 6, further comprising the step of providing altitude attitude data to said processor; and using said altitude attitude data in generating said commands to said servo system.

* * * * *